US008414213B2

(12) United States Patent
Lockhart et al.

(10) Patent No.: US 8,414,213 B2
(45) Date of Patent: Apr. 9, 2013

(54) RING BINDER COVER

(75) Inventors: Gregory L. Lockhart, Garland, TX (US); Eric S. Israel, Garland, TX (US); John C. Pyryt, Dallas, TX (US); Michael A. Lopez, Balch Springs, TX (US); Lisa L. Fitzgerald, Sachse, TX (US); Julius C. Bejsovec, The Colony, TX (US); Larry R. Byrd, Dallas, TX (US)

(73) Assignee: Lockhart Industries, Inc., Dallas, TX (US)

( * ) Notice: Subject to any disclaimer, the term of this patent is extended or adjusted under 35 U.S.C. 154(b) by 0 days.

(21) Appl. No.: 13/066,937

(22) Filed: Apr. 28, 2011

(65) Prior Publication Data

US 2011/0206446 A1 Aug. 25, 2011

Related U.S. Application Data

(62) Division of application No. 11/115,975, filed on Apr. 27, 2005, now Pat. No. 7,934,884.

(51) Int. Cl.

| | |
|---|---|
| ***B42F 3/00*** | (2006.01) |
| ***B42F 13/02*** | (2006.01) |
| ***B42F 13/06*** | (2006.01) |
| ***B42F 13/08*** | (2006.01) |

(52) U.S. Cl. ..... 402/70; 402/13; 402/15; 402/73; 402/75

(58) Field of Classification Search ..... 402/26–45, 402/70, 73, 75, 13, 15; 281/21.1, 27.1, 27.2, 281/15.1

See application file for complete search history.

(56) References Cited

U.S. PATENT DOCUMENTS

| | | | | |
|---|---|---|---|---|
| 908,597 | A | 1/1909 | Morden | |
| 944,653 | A * | 12/1909 | Bayles | 402/28 |
| 1,577,558 | A | 3/1926 | Brown et al. | |
| 2,012,572 | A | 8/1935 | Linsky | |
| 2,243,855 | A | 6/1941 | Crosby | |
| 2,321,560 | A | 6/1943 | Trussell | |
| 2,322,177 | A * | 6/1943 | Trussell | 402/75 |
| 2,324,460 | A | 7/1943 | Trussell | |
| 3,313,303 | A | 4/1967 | Beyer | |
| 3,313,304 | A | 4/1967 | Beyer | |
| 3,362,411 | A | 1/1968 | Moller | |
| 3,927,949 | A | 12/1975 | Clinch | |
| 4,139,216 | A | 2/1979 | Saint Clair | |
| 4,264,228 | A | 4/1981 | Staats | |
| 4,577,985 | A | 3/1986 | Beyer | |
| 4,750,884 | A | 6/1988 | Bourgeois et al. | |
| 5,104,250 | A | 4/1992 | Pacione | |
| 5,275,438 | A | 1/1994 | Struhl | |

(Continued)

OTHER PUBLICATIONS

Merriam-Webster's Online Dictionary. Definition of Paper. http://www.m-w.com/ 2008.

*Primary Examiner* — Dana Ross
*Assistant Examiner* — Kyle Grabowski
(74) *Attorney, Agent, or Firm* — Law Office of William Gustavson, PC

(57) ABSTRACT

A cover (10) is disclosed for holding objects such as papers and reports. The cover (10) is formed of a member (12) having a front cover (14), a spine (16) and a back cover (18), a ring binder (22) and a paper surround (24). The paper surround (24) encapsulates the ring binder (22) and secures it to the member (12). The cover can be either a top bound or side bound cover.

18 Claims, 20 Drawing Sheets

U.S. PATENT DOCUMENTS

| | | | |
|---|---|---|---|
| 5,405,209 | A | 4/1995 | Johns et al. |
| 5,435,598 | A | 7/1995 | Robinson |
| 5,545,087 | A | 8/1996 | Seward |
| 5,667,323 | A | 9/1997 | Whaley |
| 5,845,772 | A | 12/1998 | Cieplak |
| 6,062,760 | A | 5/2000 | Whaley |
| 6,666,608 | B1 | 12/2003 | Chen |
| 2002/0015613 | A1 | 2/2002 | Kapur et al. |
| 2002/0076262 | A1 | 6/2002 | To |

* cited by examiner

RING BINDER COVER

CROSS-REFERENCE TO RELATED APPLICATIONS

This application is a division of pending U.S. Pat. No. application Ser. No. 11/115,975 filed Apr. 27, 2005.

TECHNICAL FIELD

This invention relates to a professional looking ring binder cover for holding three or two Hole punched documents. The ring binder cover can be top bound or side bound.

BACKGROUND OF THE INVENTION

It is often desirable to place papers and documents in a cover for storage and protection. A common method is to put two or three punched holes in an edge of the papers and fit them over a two or three ring binder in a cover. Side bound covers typically use three ring binders while top bound covers typically use two ring binders.

It is desirable to provide identification on the cover's spine or front to note the contents of the cover, assuming that it will be placed on a shelf or in a file drawer with other covers, in order to distinguish one cover from another. Also, it is desirable to put a firm or company name or logo on the cover to provide a professional appearance.

A need exists to provide an elegant, high image professional looking cover which is also economical and easy to assemble. It is also desirable to make it as easy as possible to insert and remove papers from the cover. This makes it easier to remove or add documents in revisions, or to take out documents for copying. Also, it is desirable to have the cover allow the contents to lie flat on a table. Further, as such covers are often used on surfaces that can be scratched, it is best to avoid use of metal, or other hard objects, such as rivets or the like that could scratch or mar a surface.

SUMMARY OF THE INVENTION

In accordance with one aspect of the present invention, a cover is provided comprising a member forming a front cover, spine and rear cover, a ring binder and a flexible surround encapsulating the ring binder and securing the ring binder to the member. The flexible surround can be a paper surround. In accordance with another aspect of the present invention, the paper surround forms a portion of the member. In accordance with another aspect of the present invention, the cover is either a top bound or a side bound cover.

The ring binder can include a base and a plurality of ring elements. The ring elements are linear to facilitate shipment and placement of documents on the ring elements and subsequently bendable to form a loop to hold the documents. The ring elements each have a free end, with the base having an aperture to receive the free end. The ring elements can be thicker in the middle than at the ends to enhance service life. Ring elements that are thicker in the middle can also improve the symmetry of the loop formed by the ring elements to hold the papers. The ring elements can have ridges along their length to enhance symmetry and service life.

In accordance with another aspect of the present invention, the member and paper surround can be of the same color. The paper surround can have apertures therein for passage of the ring elements. The paper surround can also have adhesive to secure the paper surround about the ring binder and to secure the paper surround and ring binder to the member.

BRIEF DESCRIPTION OF THE DRAWINGS

A more complete understanding of the invention and its advantages will be apparent from the following Detailed Description when taken in conjunction with the accompanying Drawings, in which.

DETAILED DESCRIPTION

Figure 1:
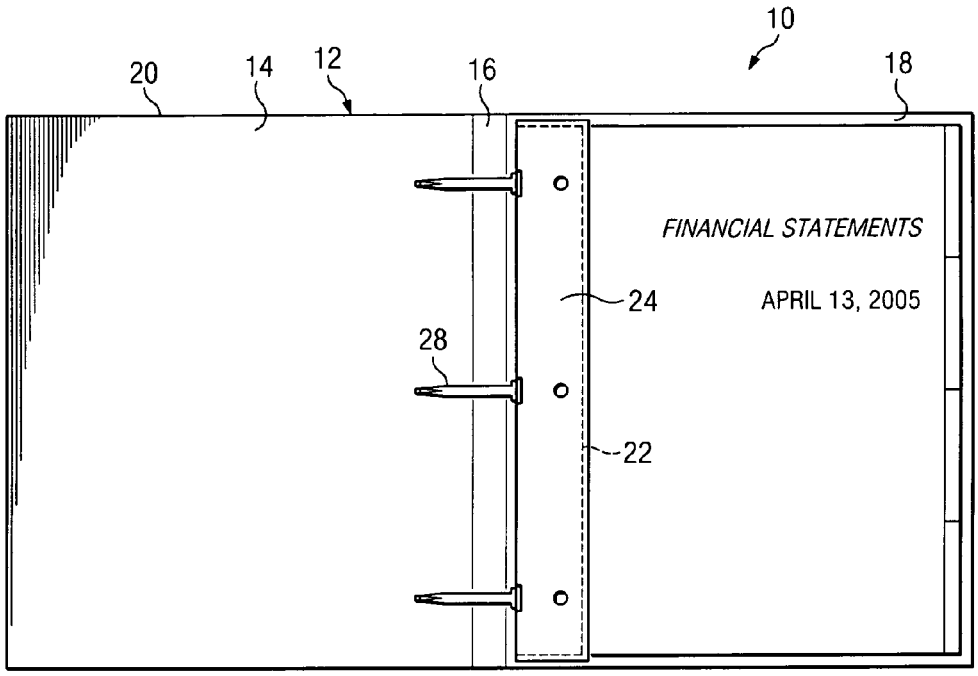
FIG. 1 is a plan view of a cover forming a first embodiment of the present invention.

With reference now the Figures, wherein like reference characters designate like or corresponding parts throughout the several views, and in particular to FIG. 1, a cover 10 forming a first embodiment of the present invention is disclosed. The cover 10 is designed to contain objects such as papers, documents, reports, and other items secured in the cover 10, preferably by holes at an edge of the objects as is commonly done in three ring binders and the like.

With reference now to FIG. 1, the cover 10 can be seen to include a member 12 forming the front cover 14, spine 16 and back cover 18 of the cover 10. The member 12 is preferably formed by a single integral sheet of material 20, such as 130 lb, 160 lb, 210 lb, 240 lb or 260 lb paper. The cover 10 also includes a ring binder 22 secured to the member 12 by a paper surround 24 as will be discussed hereinafter.

Figure 2:
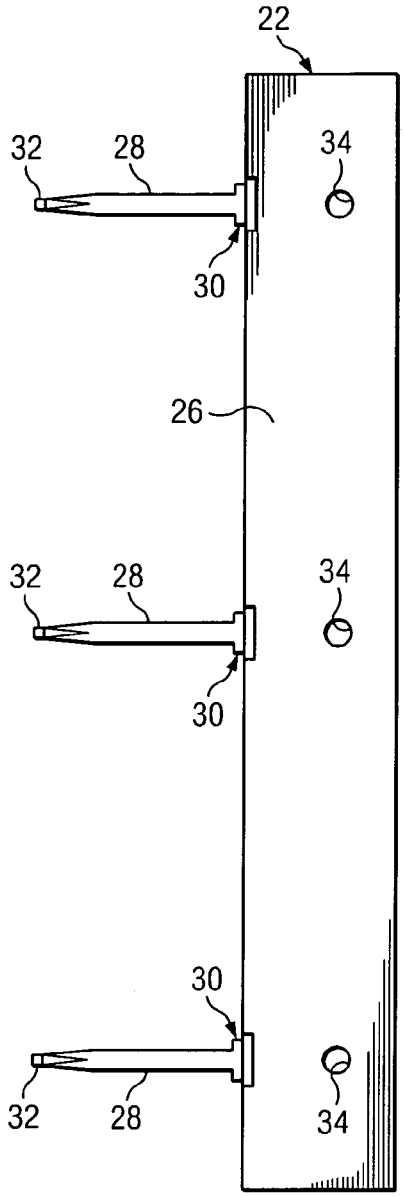
FIG. 2 is a plan view of the ring binder used in the cover.

As seen in FIG. 2, the ring binder 22 has a base 26 and a series of ring elements 28. Three ring elements 28 are shown in FIG. 2, allowing the ring binder 22 to be used to hold objects with conventional three hole punching. However, it will be understood that any number of ring elements 28 can be used, and the ring elements 28 can be substituted with spiral binding elements, GBC binding elements or other binding elements as desired to accept a particular type of object.

Figure 4A:
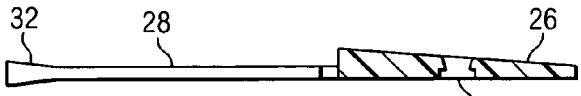
FIGS. 4*a*, 4*b* and 4*c* are views of the ring binder.
Figure 4C:
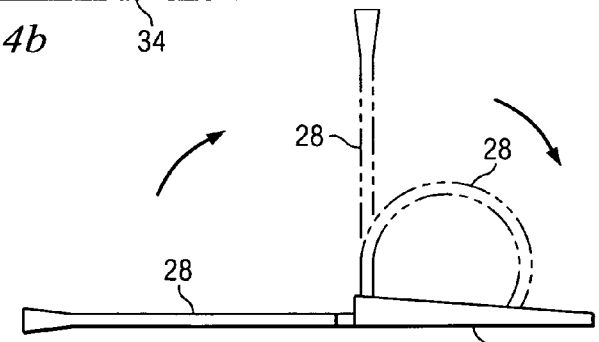
Figure 5A:
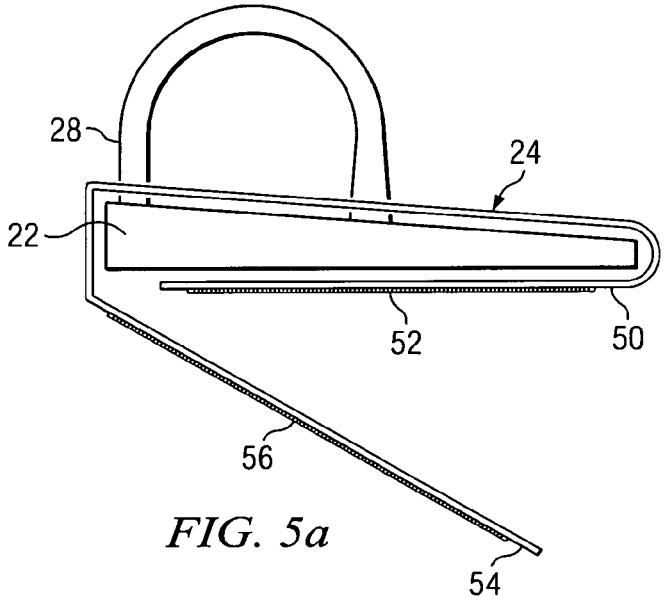
FIGS. 5*a*, 5*b* and 5*c* are views of the ring binder and paper surround being assembled.
Figure 5B:
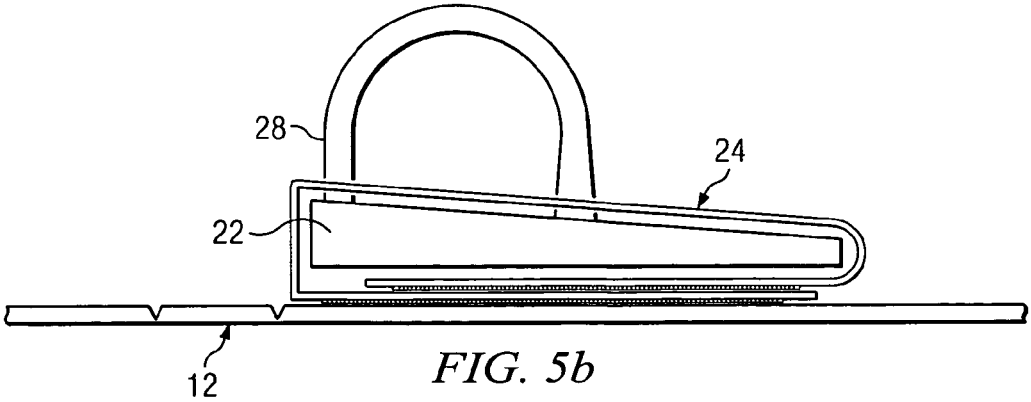

The ring binder 22 is preferably formed of molded plastic, with the ring elements 28 molded to the base 26 through living hinges 30 that permit the ring elements 28 to pivot relative the base 26. It should be noted the ring elements 28 shown in FIG. 2 are linear and extend directly outward from the left edge of the base 26 so that the ring binder 22 is flat to facilitate shipping of the cover 10. It is anticipated that the cover 10 will be shipped and supplied to the customer unassembled, with the member 12, ring binder 22 and paper surround 24 then secured together by the customer. The ability to ship a flat ring binder 22 is a significant advantage. In addition, as will be described in greater detail, the ring elements 28 can be pivoted upright, perpendicular the base 26, as seen in phantom line in FIG. 4*c*, to facilitate placement of the objects over the ring elements 28 before the ring elements 28 are bend to form rings or loops to capture the objects as shown in FIGS. 5*a* and 5*b*. The free ends 32 of the ring elements 28 are bent over and removably secured in apertures 34 in the base 26 as shown in FIGS. 5*a* and 5*b*. The ring elements 28 are preferably between about 0.035 inch to 0.100 inch thick to provide sufficient flexibility, yet adequate strength, to be deformed into loops to hold the papers in the cover 10. Preferably, the ring elements are also about 3/16 inch wide to easily accept paper with ¼ inch holes. The ring binder 22 is preferably made of polypropylene or nylon. Also, the ring binder 22 is preferably treated with a UV resistant coating.

Figure 4B:
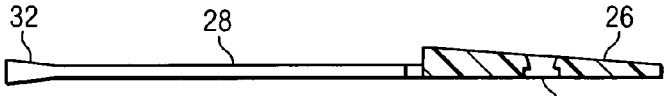

In one ring binder 22 formed in accordance with the present invention, the ring elements 28 were 0.046 inches thick and the base 26 tapered from a thickness of 0.122 inches at its thickest edge. The ring binder 22 was 11 inches long and the base 26 was 1.377 inches wide. The apertures 34 were centered about 0.741 inches from the thick edge of the ring binder 22 where the living hinges 30 are formed. The ring elements were about 1.48 inches long to form ½ inch diameter loops (FIG. 4*a*) and 1.98 inches long to form ¾ inch diameter loops (FIG. 4*b*).

Figure 3A:
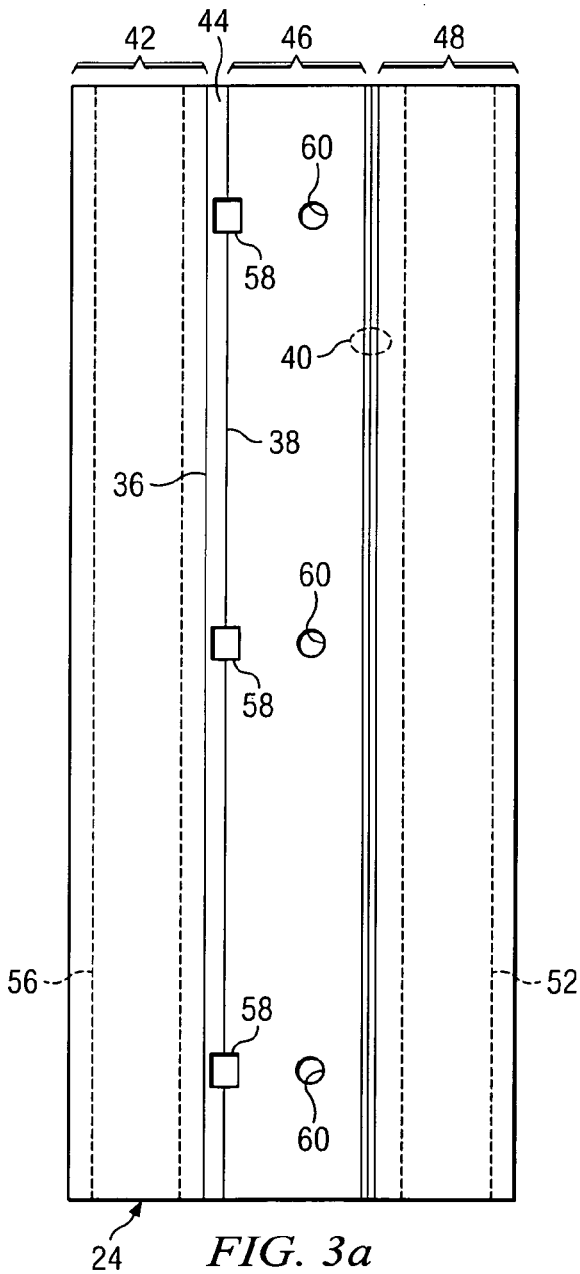
FIGS. 3*a* and 3*b* are views of the paper surround used in the cover.
Figure 3B:
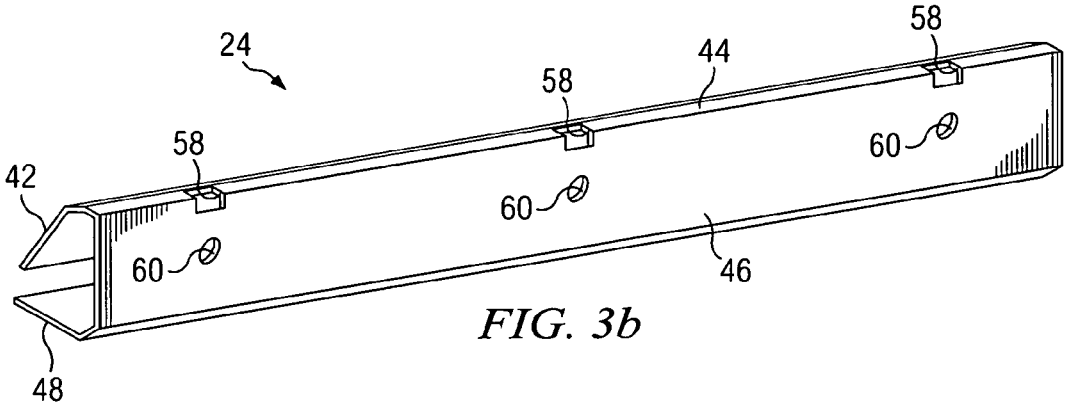
Figure 5C:
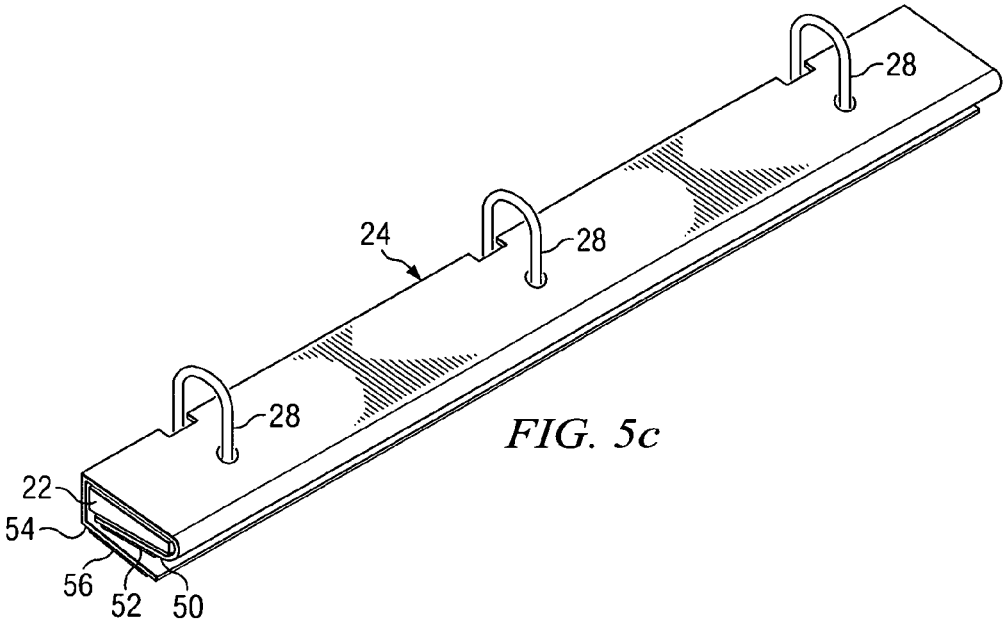

The paper surround 24 encapsulates the ring binder 22 and secures it to the member 12. As seen in FIGS. 3*a*, and 3*b*, the paper surround 24 is formed of a single sheet of paper, preferably 130 lb, 160 lb, 210 lb, 240 lb or 260 lb stock, that has score lines 36, 38 and 40 to define outer back panel 42, spine panel 44, front panel 46 and inner back panel 48. The paper surround 24 is folded about the ring binder 22 as best seen in FIG. 5*a-c*. The ring binder 22 is tapered from its thick edge where ring elements 28 are hinged, to the opposite side, as seen in FIGS. 4*a-b*. By tapering the ring binder 22, the paper surround 24 fits about the ring binder 22 in a very neat and attractive manner. Preferably, the score line 40 is actually three score lines side by side to facilitate the bending of the paper surround 24 almost 180 degrees between front panel 46 and inner back panel 48 about the thin edge of the ring binder 22. While paper surround 24 is preferably of paper, it can also be made of any suitable flexible material, such as plastic, leatherette, a composite material and the like. As shown in FIG. 1, the thick edge of the ring binder 22 is adjacent the spine 16. As such, papers must be placed over the ring elements facing downwardly before the ring elements are bent over to form loops. If desired, the ring binder 22 and paper surround 24 can be reversed from this orientation, that is the thick edge of the ring binder 22 can face away from the spine. This would allow upward facing papers to be placed over the ring elements and the ring elements then bent to the left toward the spine 16 to secure the free ends 32 in the apertures 34.

Figure 10:
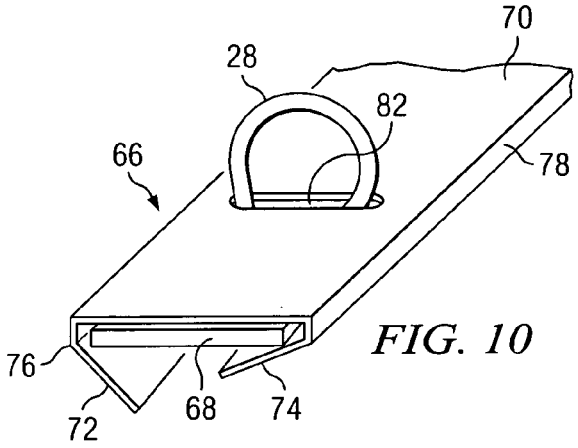
FIG. 10 is a perspective view of an alternative design for the ring binder and paper surround.

The outer surface 50 of the inner back panel 48 has an adhesive strip 52 thereon to secure the inner and outer back panels 42 and 48 together to encapsulate the ring binder 22. The outer surface 54 of outer back panel 42 has an adhesive strip 56 thereon to secure the paper surround 24 and ring binder 22 to the member 12. Rather than a single adhesive strip 56, two or more adhesive strips can be used to secure paper surround 24 to member 12. The front panel 46 of the paper surround 24 has a series of apertures 58 for passage of the ring elements 28 and apertures 60 for passage of the free ends 32 of the ring elements 28 when the ring elements 28 are formed into loops. As shown in the Figures, apertures 58 are preferably rectangular and extend a short distance, perhaps 1/16 inch, into the spine panel 44 so that the ring elements 28 can be bent back from apertures 60 without tearing the paper surround 24 as when placing or removing papers from the ring binder 22. Alternatively, the apertures 58 and 60 associated with a ring element 28 can be replaced by a single notch in the paper surround 24, such as seen in FIG. 10, extending to both ends of the ring element 28.

One paper surround 24 made in accordance with the teachings of the present invention is 11 inches long with the inner back panel 48 being 1 5/16 inch wide, the front panel 46 being 1 3/8 inch wide, the spine panel 44 being 3/16 inch wide and the outer back panel 42 being 1 3/8 inches wide. The apertures 60 were circular, with a diameter of ¼ inch. The apertures 58 were rectangular with width of 0.2188 inches and length of 0.076 inches.

As can be understood, the cover 10 can be readily and easily shipped with member 12, ring binder 22 and paper surround 24 as separate components in a kit. The customer can open the kit, pivot ring elements 28 perpendicular the base 26 and insert the ring elements 28 in the apertures 58 of paper surround 24. The paper surround 24 can then be wrapped about the ring binder 22, encapsulating the ring binder 22 therein by activating the adhesive strip 52 to secure inner and outer back panels 42 and 48 together. The adhesive strip 56 can then be activated to secure the paper surround 24 and ring binder 22 to the back cover 18 of the member 12 near the spine 16. At this point, objects can be fit over the upstanding ring elements 28 easily, as the ring elements 28 are linear. Once the objects are inserted, the ring elements 28 can be bent over one by one to secure their free end 32 in aperture 34 to capture the objects in the cover 10. The free ends 32 have enlarged diameter dimples or disks at their end that are deformed through the aperture 34 and then snap back on the other side of the aperture 34 to snap fit the free ends 32 in the apertures 34. The free ends 32 can be readily unsnapped to insert more objects, or remove the ones already there for copying and the like. Of course, cover 10 can be sold to the customer already assembled.

Figure 34:
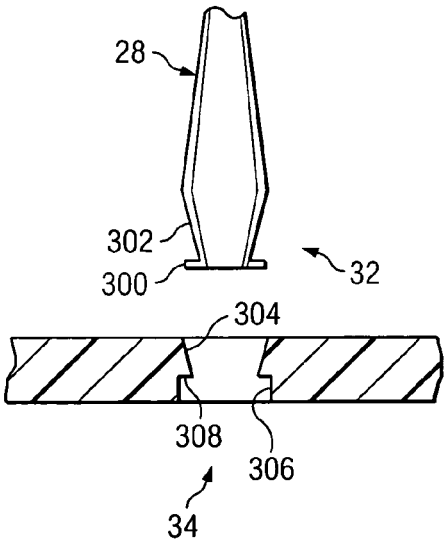
FIG. 34 is a detail view of the free end of a ring element adjacent the base.
Figure 35:
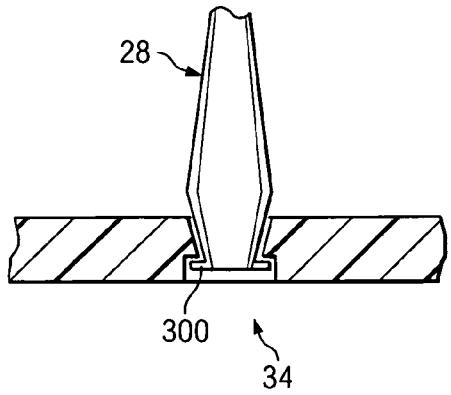
FIG. 35 is a detail view of the free end fit in the aperture of the base.

FIGS. 34 and 35 illustrate the details of one type of disk 300 at the free end 32 of the ring elements 28. The free end 32 can be seen to have a slight taper 302 toward the end of the ring element 28 and then expands into the disk 300. When the free end 32 is pushed into the opening of aperture 34, the disk 300 deforms against an inwardly tapering portion 304 of the aperture 34 and springs out to its undeformed shape as it is pushed into the enlarged portion 306 of the aperture 34. The annular rim 308 formed between the portions 304 and 306 prevents the disk 300 from being pulled back through the aperture 34 in normal use. Only when sufficient force is used to again deform the disk 300 past the rim 308 and through the portion 304 will the free end 32 be unsecured from the base, such as when desired to add or remove pages from the cover 10 during use.

Figure 8:
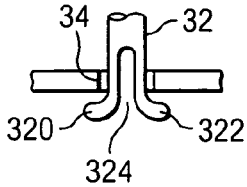
FIG. 8 is a detail view of the free end of the ring element received in the ring binder base.

An alternative design to secure free end 32 in aperture 34 is shown in FIG. 8 where the free end 32 is bifurcated into a first outwardly curving portion 320 and a second outwardly curving portion 322. A gap 324 normally exists between the two portions 320 and 322 as shown. When inserting the free end 32 into aperture 34, the portions 320 and 322 are deflected toward each other, closing the gap 324, in order to pass the portions 320 and 322 through the aperture. On the other side of the aperture 34, the portions 320 and 322 again expand and retain the free end secured in the aperture during normal use.

Another alternative is to simply enlarge the free end 32 into a ball or ovoid shape that can be deformed or compressed past the aperture 34 to secure the free end 32 in the aperture.

Figure 6:
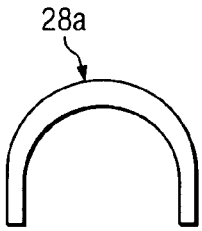
FIG. 6 is a side view of a ring element on the ring binder.
Figure 7:
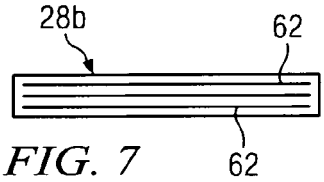
FIG. 7 is an under side view of an alternative ring element on the ring binder.

FIG. 6 shows one type of ring element 28*a* which has a thicker middle to enhance the durability of the element. Ring element 28*a* would also be expected to form a more uniform diameter loop. FIG. 7 shows another type of ring element 28*b* with a series of ridges 62 along its inner surface to enhance durability.

Figure 9:
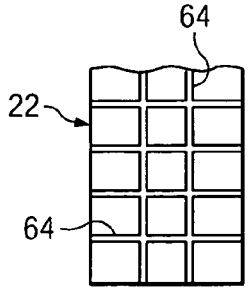
FIG. 9 is a detail view of a portion of the back of the ring binder.

If desired, the ring binder 22 can be attached directly to the member 12 by adhesive without use of the paper surround 24. FIG. 9 illustrates the design of the back of a ring binder 22 with a series of egg carton like ribs 64 that would give greater surface area for adhesive to bind the ring binder 22 to the member 12.

Figure 11:
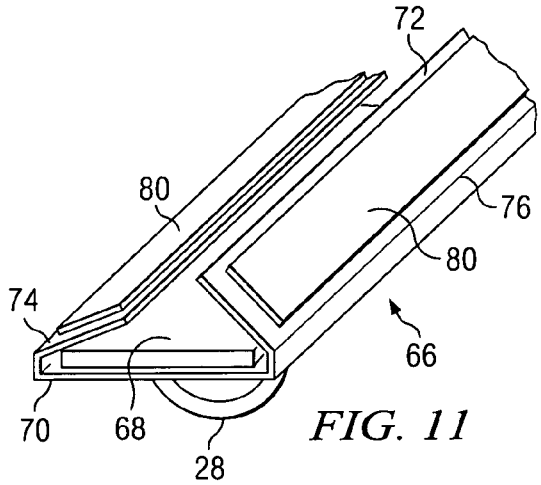
FIG. 11 is an underside perspective view of the alternative design of FIG. 10.

FIGS. 10 and 11 illustrate an alternative construction using a paper surround 66 and ring binder 68. Paper surround 66 has a front panel 70, a first back panel 72 and a second back panel 74 defined by score lines 76 and 78. The paper surround 66 encapsulates the ring binder 68 as shown, with an adhesive strip 80 on the back surface of each of the back panels 72 and 74. The adhesive strips 80 adhere the paper surround 66 to the member 12 with the ring binder 68 encapsulated therein. The front panel 70 has apertures 82 for passage of the ring elements 28.

Figure 12A:
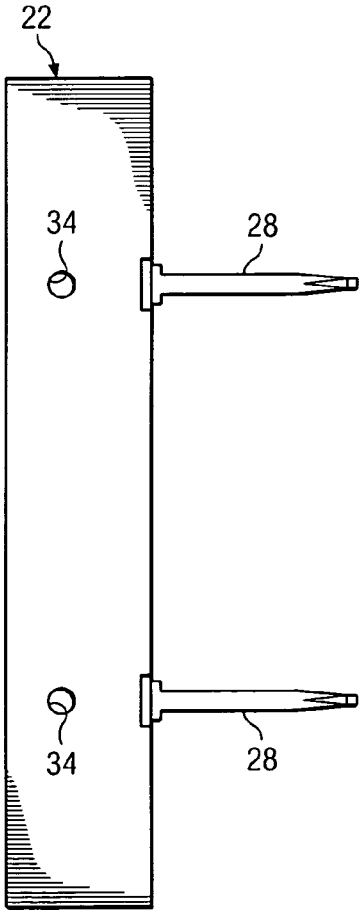
FIGS. 12*a*, 12*b*, and 12*c* are views of a top bound cover of the present invention.
Figure 12B:
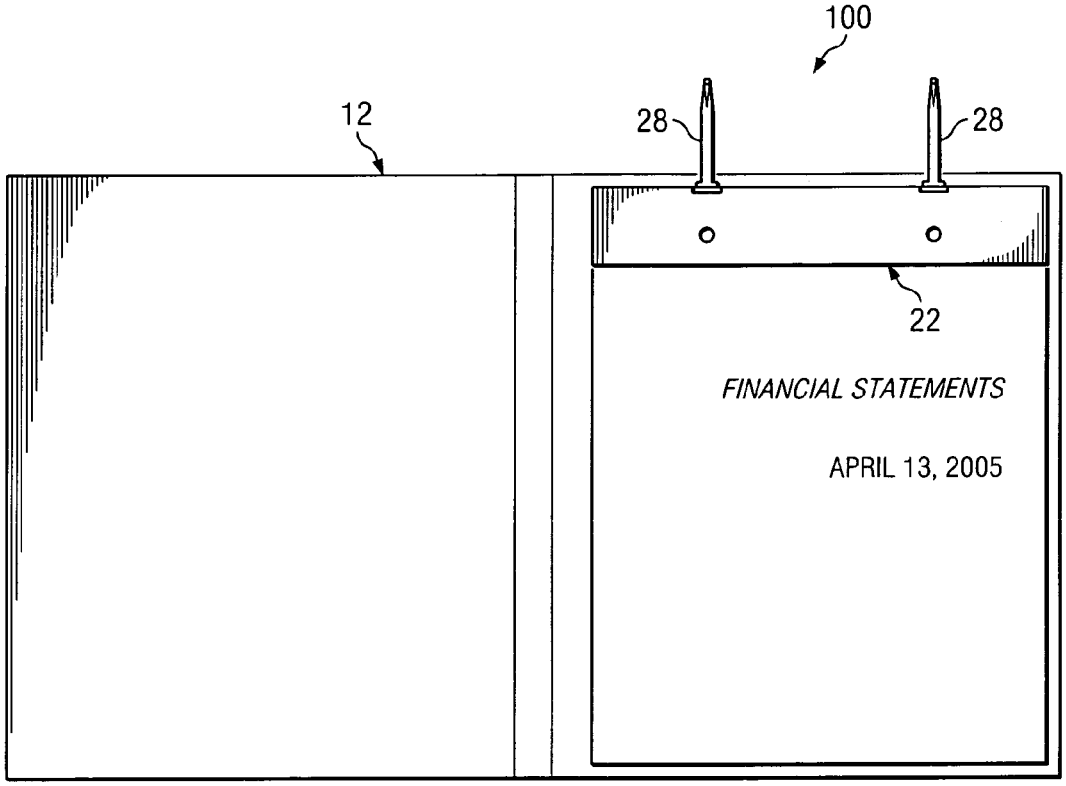
Figure 12C:
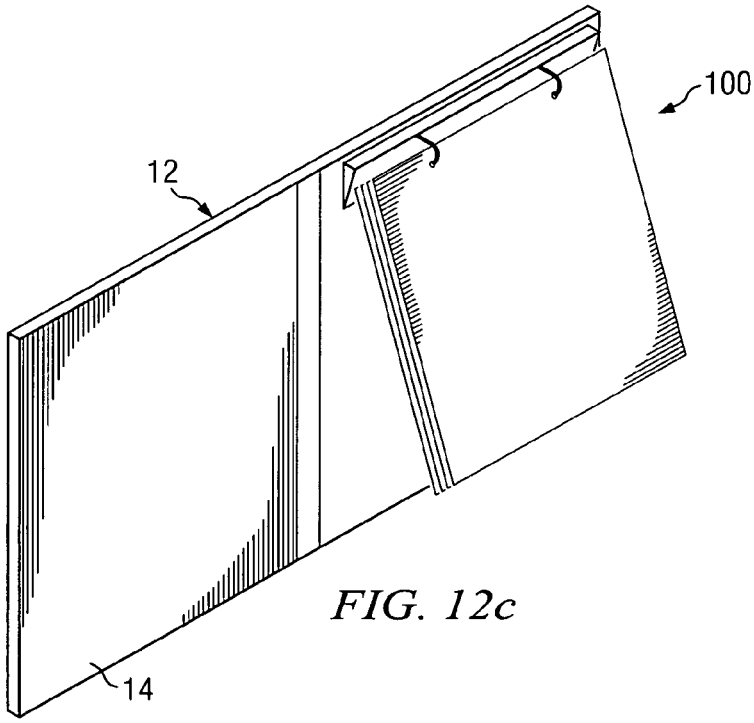
Figure 13D:
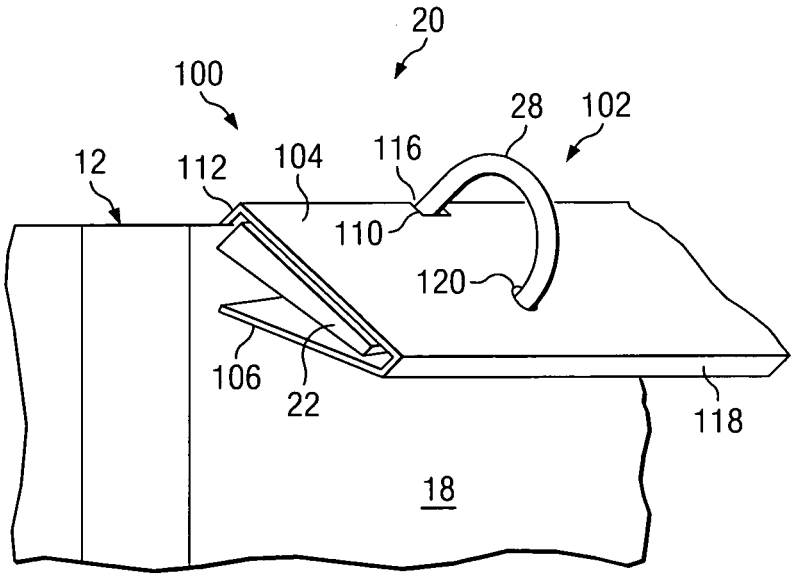
Figure 14:
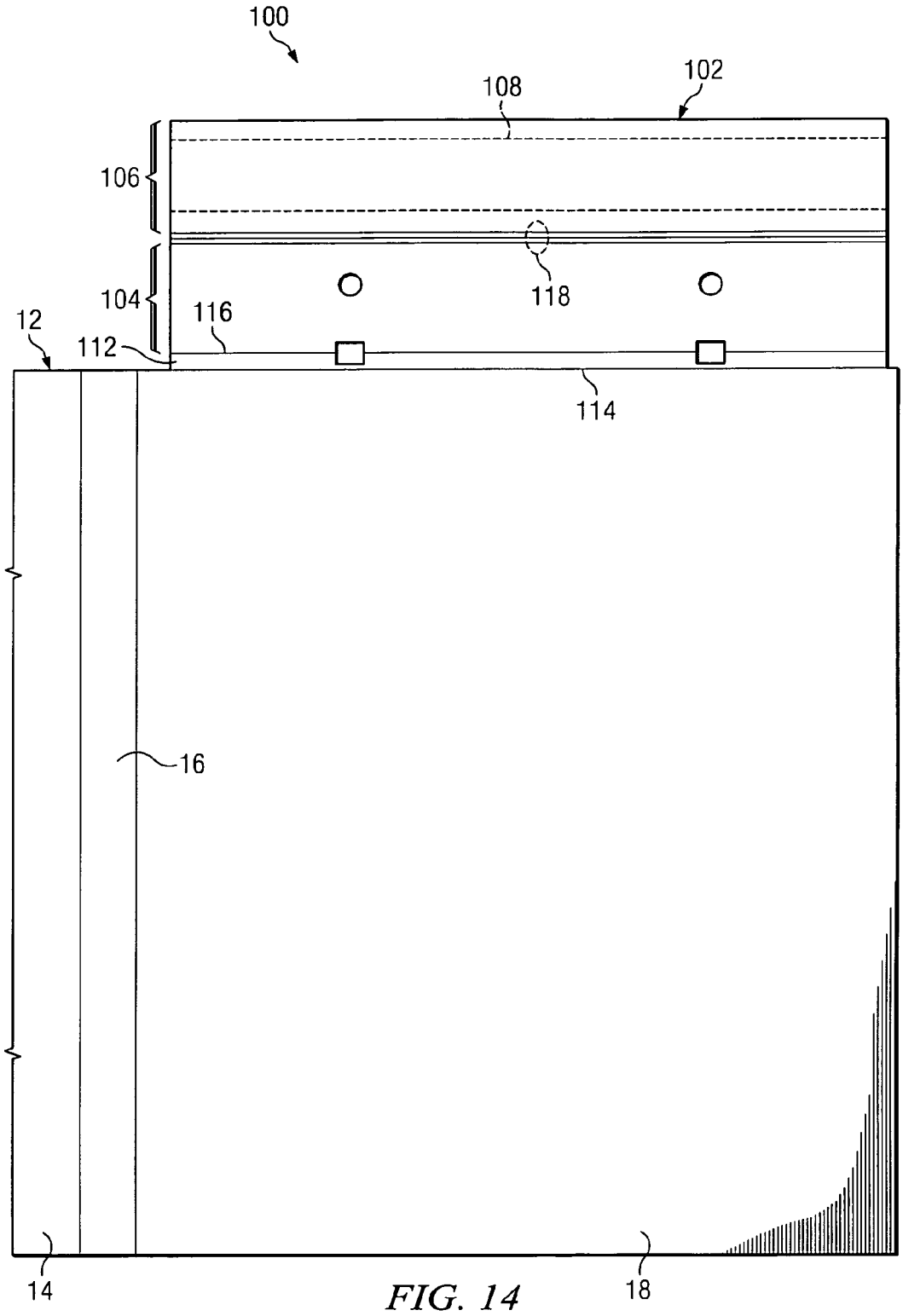
FIG. 14 is a plan view of the top bound cover illustrating the integral paper surround before folding.

FIGS. 12*a, b* and *c*, 13*d* and 14 illustrate a top bound cover 100. In this design, the ring binder 22 would use only two ring elements 28. The paper surround 102 is formed as an integral extension from the back cover 18 of the member 12 as best seen in FIG. 14 and FIG. 13*d*. The paper surround 102 has front panel 104, top panel 112 and back panel 106 that encapsulates the ring binder 22 as shown in FIG. 13*d*. The panels 104, 106 and 112 are folded at fold lines 114, 116 and 118 to encapsulate the ring binder 22. An adhesive strip 108 on the back surface of the back panel 106 is activated to secure the back panel 106 to the inner surface of the back cover 18 to secure the encapsulation of the ring binder 22. The front panel 104 has apertures 110 and 120 for passage of the ring elements 28. As noted previously, apertures 110 are rectangular and extend into the top panel 112, preferably about 1/16 inch, to provide clearance for the ring elements 28.

Figure 13A:
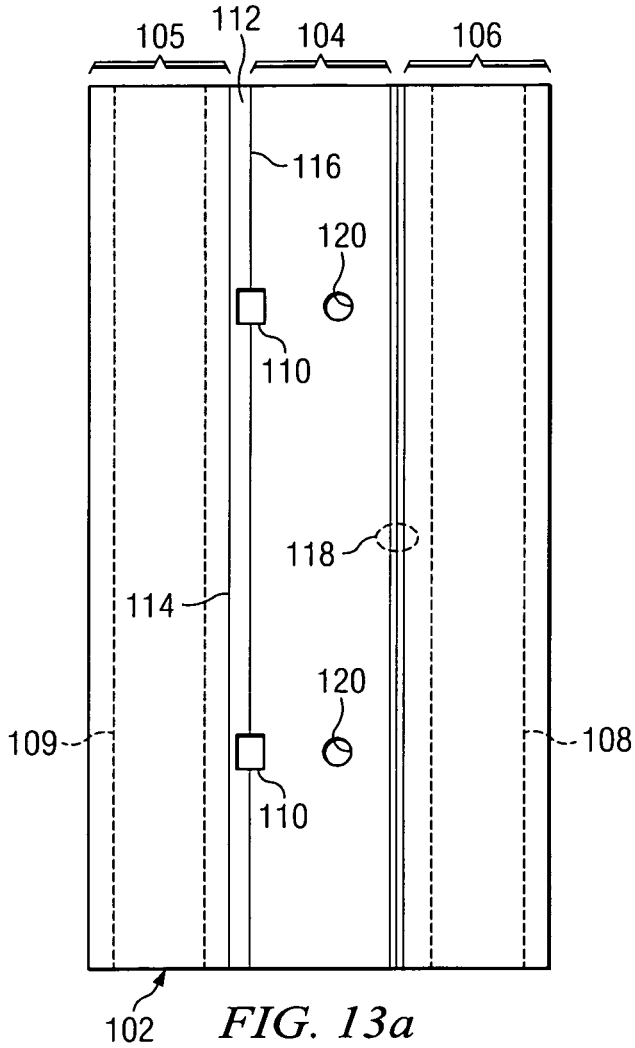
FIGS. 13*a*, 13*b*, 13*c*, and 13*d* are views of portions of the top bound cover of FIG. 12*a-c* illustrating the paper surround either forming a portion of the back cover or as a separate element.
Figure 13B:
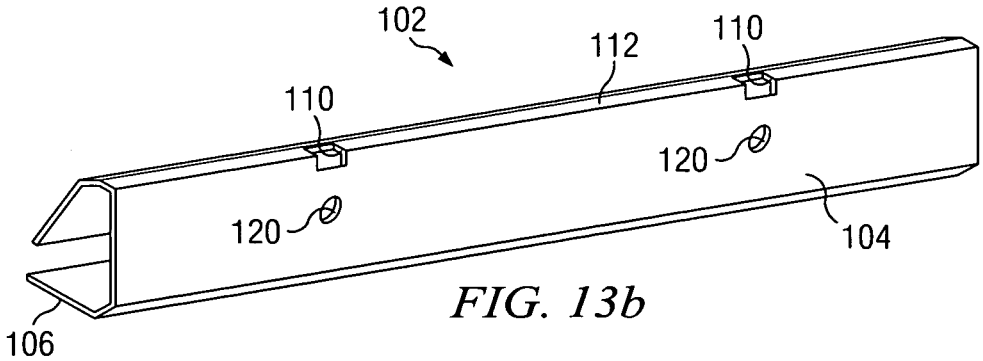
Figure 13C:
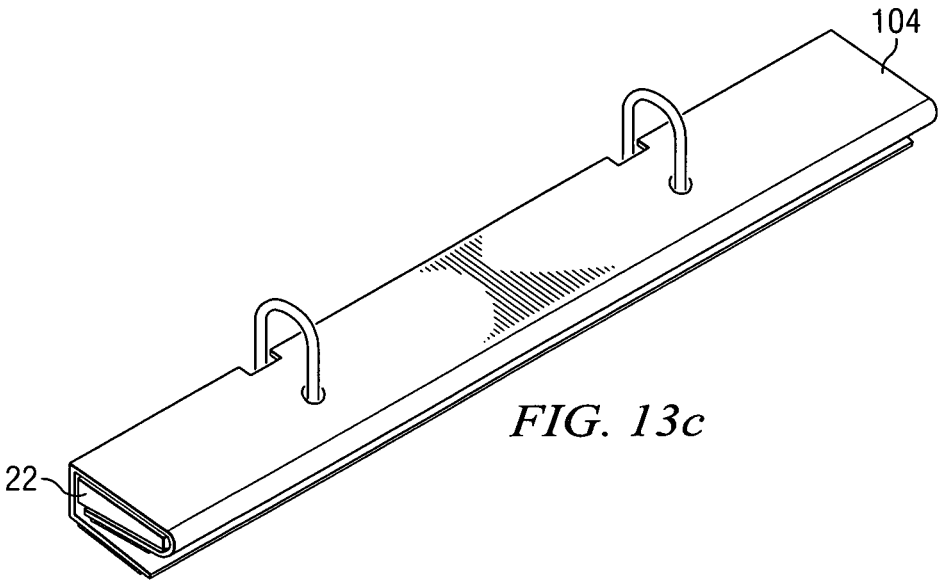

FIGS. 13*a, b* and *c* show a variation where the paper surround 102 is separate from the member 12. As seen in these figures, only an additional outer back panel 105 (much like used in paper surround 24) is needed to carry adhesive strip 109 to secure the paper surround 102 to the member 12. Adhesive strip 108 thus secures panel 106 to panel 105 to encapsulate the ring binder.

One paper surround 102 made in accordance with the teachings of the present invention had a length of 8½ inches (corresponding to the width of 8½ inches of the paper to be top bound). The other dimensions were identical to the paper surround 24 described above, using, of course, only two apertures 58 and 60.

Figure 15A:
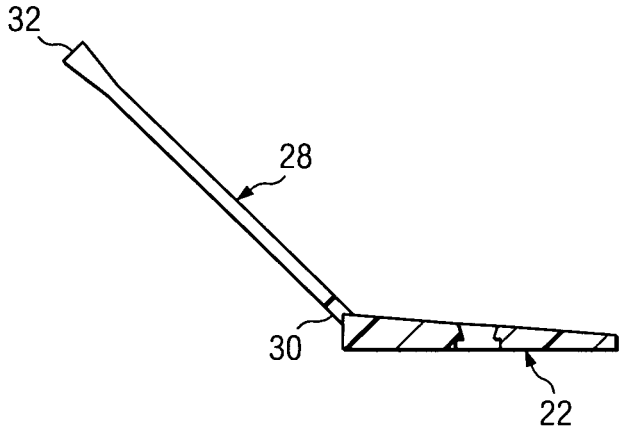
FIGS. 15*a, b* and *c* are detail views of the ring elements.
Figure 15B:
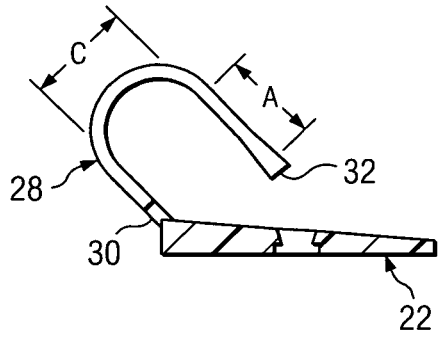
Figure 15C:
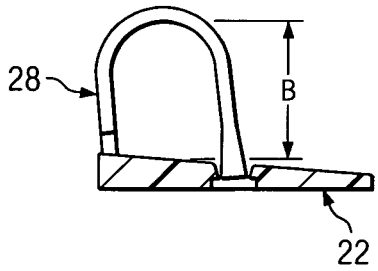

With reference to FIGS. 15*a, b* and *c*, details of the ring element 28 will be described. Preferably, at least two sizes of ring elements 28 will be available. The first size will be designed to hold about 40 to 45 pages of paper and has a dimension A of about 3/16 inch, representing the distance the ring element extends generally perpendicular the base 26 from the hinge 30 and free end 32 when holding the papers. This allows the papers to lie with their edges aligned in the cover 10. Dimension B is about ½ inch and dimension C is about 11/16 inch. As most papers are hole punched about ¼ to 5/16 inch from their edge, dimension C allows papers to be positioned on either side of the ring element with about 1/16 inch separating the edges of the papers to allow for easy page turning. The second size will be designed to hold about 100 pages, and has a dimension A of about 7/16 inch, dimension B of about ¾ inch and dimension C of about 11/16 inch. Due to the fact that one end of the ring element 28 is hinged at hinge 30, the loop formed by the ring element 28 tends not to be perfectly symmetrical, which assists in turning pages. Clearly, the ring elements 28 can be made in other sizes to fit how ever many pages are to be held by the cover. For example, the ring elements 28 can be made to hold about 200 pages or sheets.

Among the many advantages of the covers 10 and 100 is the ability to do foil stamping or embossing on the member 12 and to label the spine. This is not easily done with a typical ring binder riveted to a cover. The rivets through the spine of the cover make it difficult to label the spine. Also, the rivets can scratch a table or other surface. In contrast, the covers 10 and 100 have only paper stock on exterior surfaces, which will not cause damage to surfaces it contacts. Further, to fit in files cabinets and other storage places, the total height of the covers 10 and 100 should not exceed 12 inches. This is accomplished with the design described herein.

Figure 16:
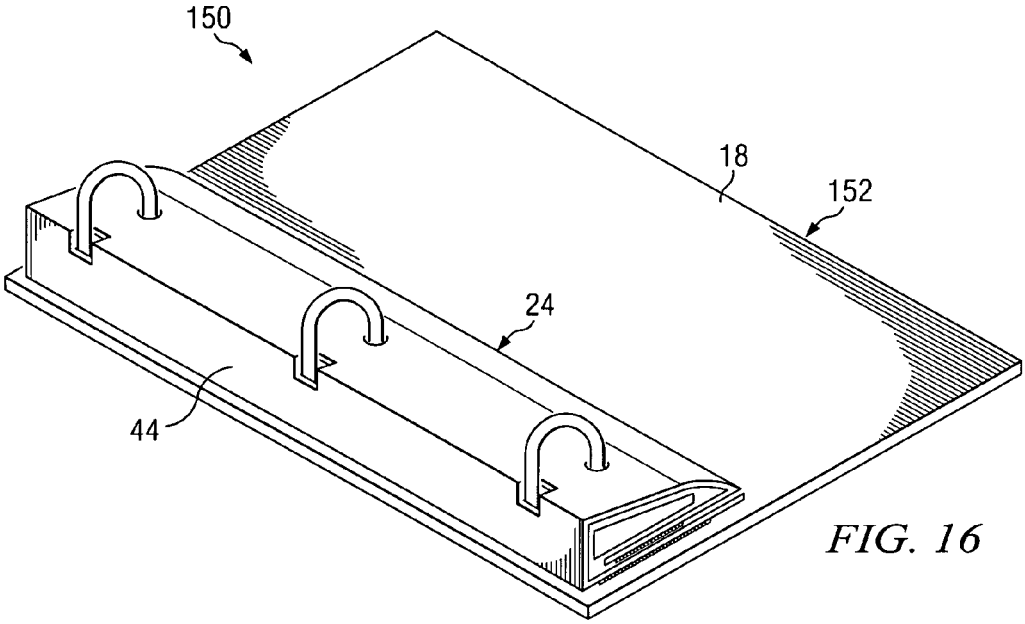
FIG. 16 is a perspective view of a side bound cover with a member having only the back cover.
Figure 18:
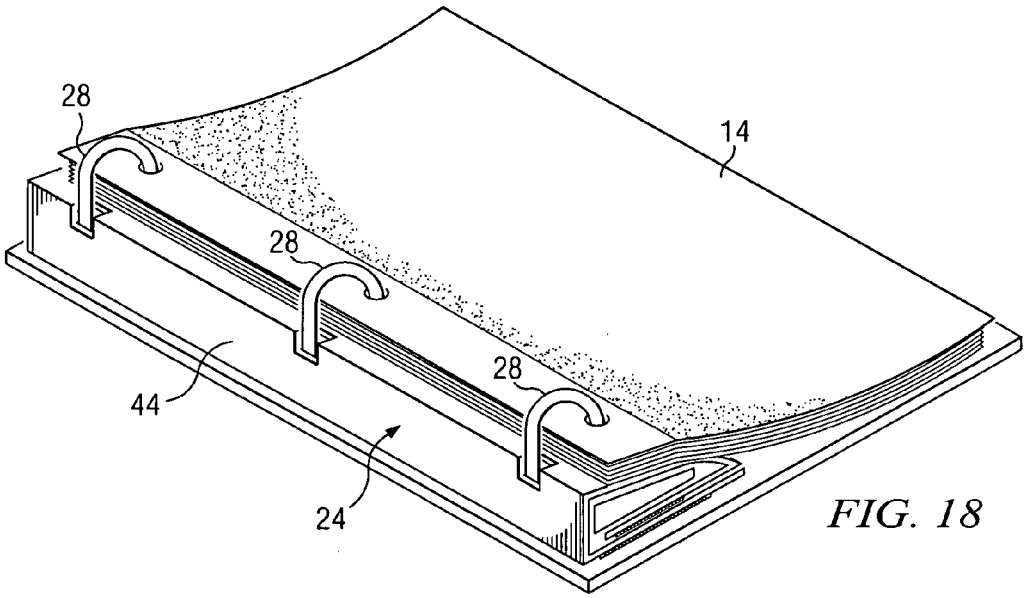
FIG. 18 is the cover of FIG. 16 shown with a front cover.
Figure 17:
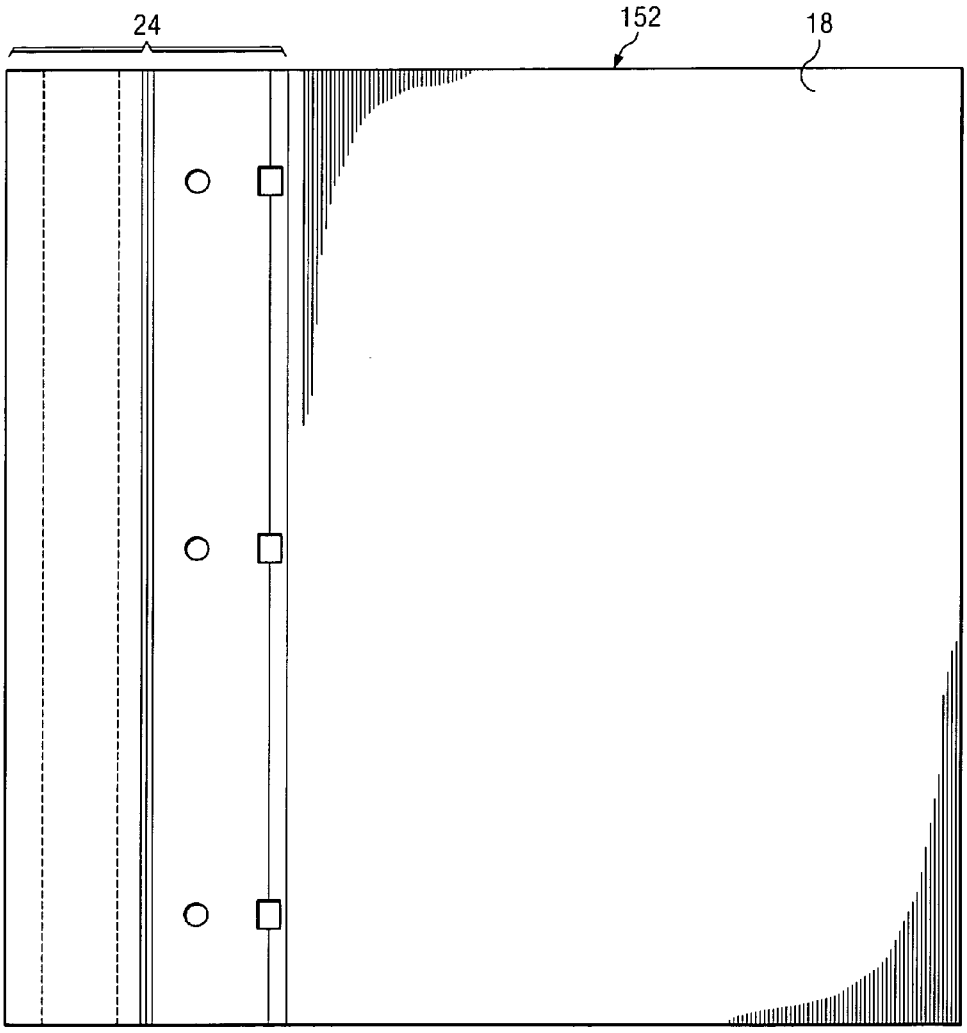
FIG. 17 is the member in the cover of FIG. 16 before folding.

With reference now to FIGS. 16, 17 and 18, a cover 150 forming a modification of the side bound cover 10 of the present invention is illustrated. Cover 150 differs from cover 10 in having a member 152 having only back cover 18. The front or top cover 14 is a separate element that has holes punched at a side edge to be received in the ring elements 28.

Thus, cover 150 doesn't have a spine 16. However, the spine panel 44 can have information written, embossed, printed, or otherwise placed thereon to help identify the contents of the cover 150. As seen in FIG. 17, as member 152 has no front cover or spine, the paper surround 24 can be formed integral with the member 152. Alternatively, the paper surround 24 can be formed separate from the member 152, and attached in the same manner paper surround 24 is attached to cover 10.

Figure 19:
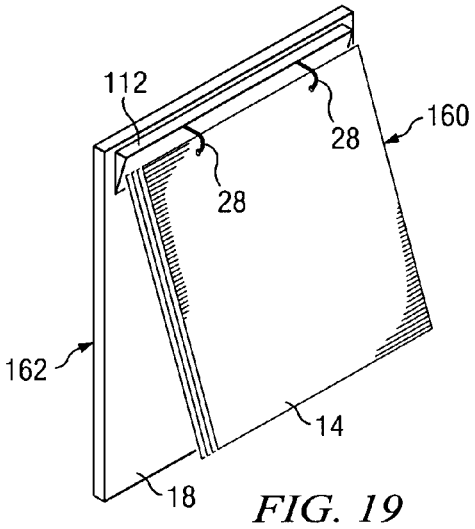
FIG. 19 is a perspective view of a top bound cover with a member having only the back cover.
Figure 20:
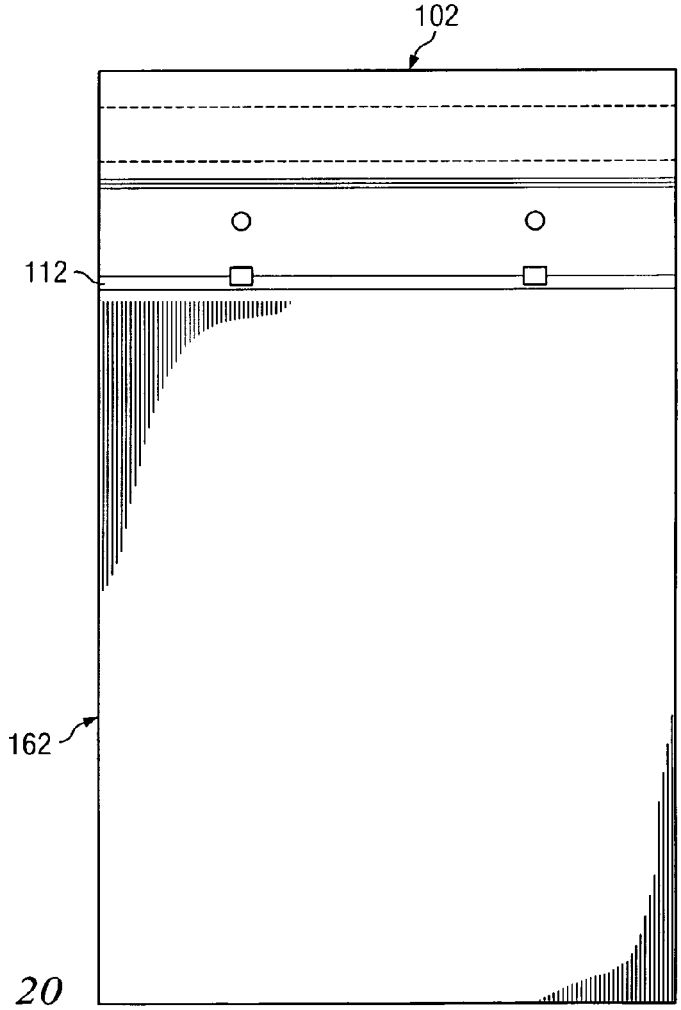
FIG. 20 is the member in the cover of FIG. 19 before folding.
Figure 21:
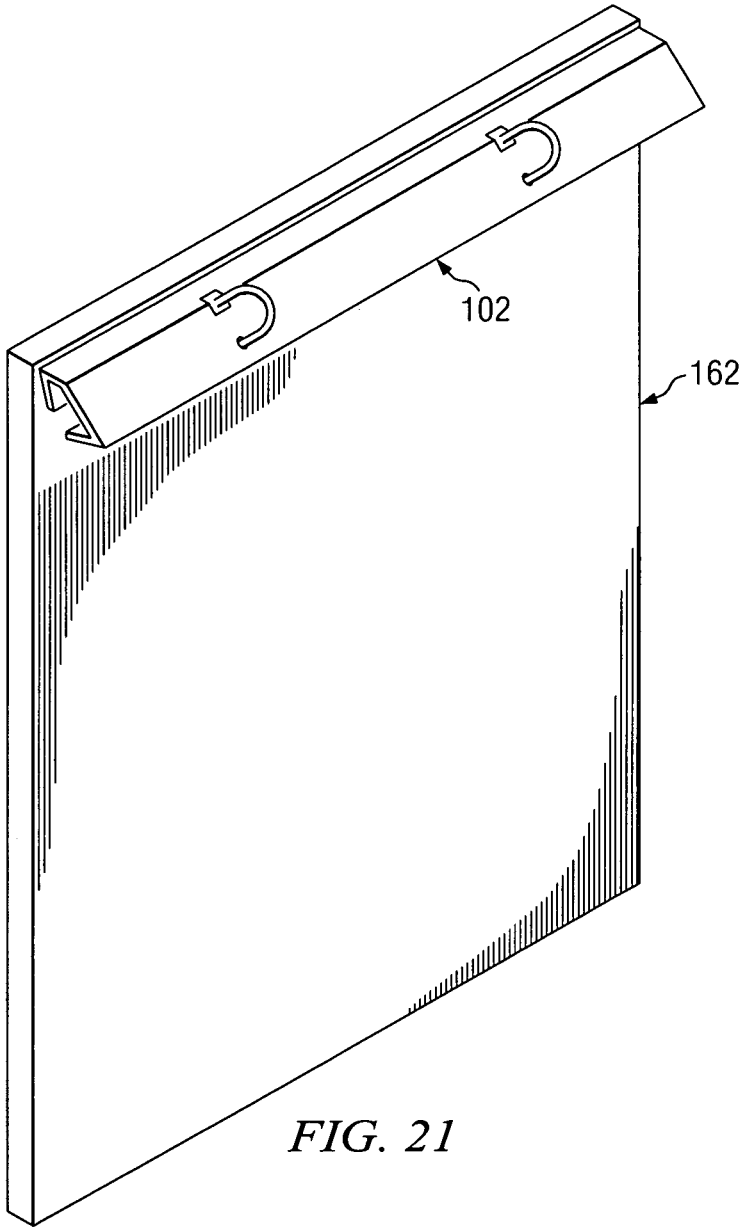
FIG. 21 is a top bound cover with a separate paper surround.

With reference now to FIGS. 19, 20 and 21, a cover 160 forming a modification of the top bound cover 100 of the present invention is illustrated. Cover 160 differs from cover 100 in having a member 162 having only back cover 18. The front or top cover 14 is a separate element that has holes punched at a top edge to be received in the ring elements 28. Thus, cover 160 doesn't have a spine 16. However, the top panel 112 can have information written, embossed, printed, or otherwise placed thereon to help identify the contents of the cover 160. As shown in FIGS. 19 and 20, the paper surround 102 can be formed integrally with the member 162. Alternatively, the paper surround 102 can be formed separate from the member 162 and attached to member 162 by adhesive as shown in FIG. 21.

Figure 22:
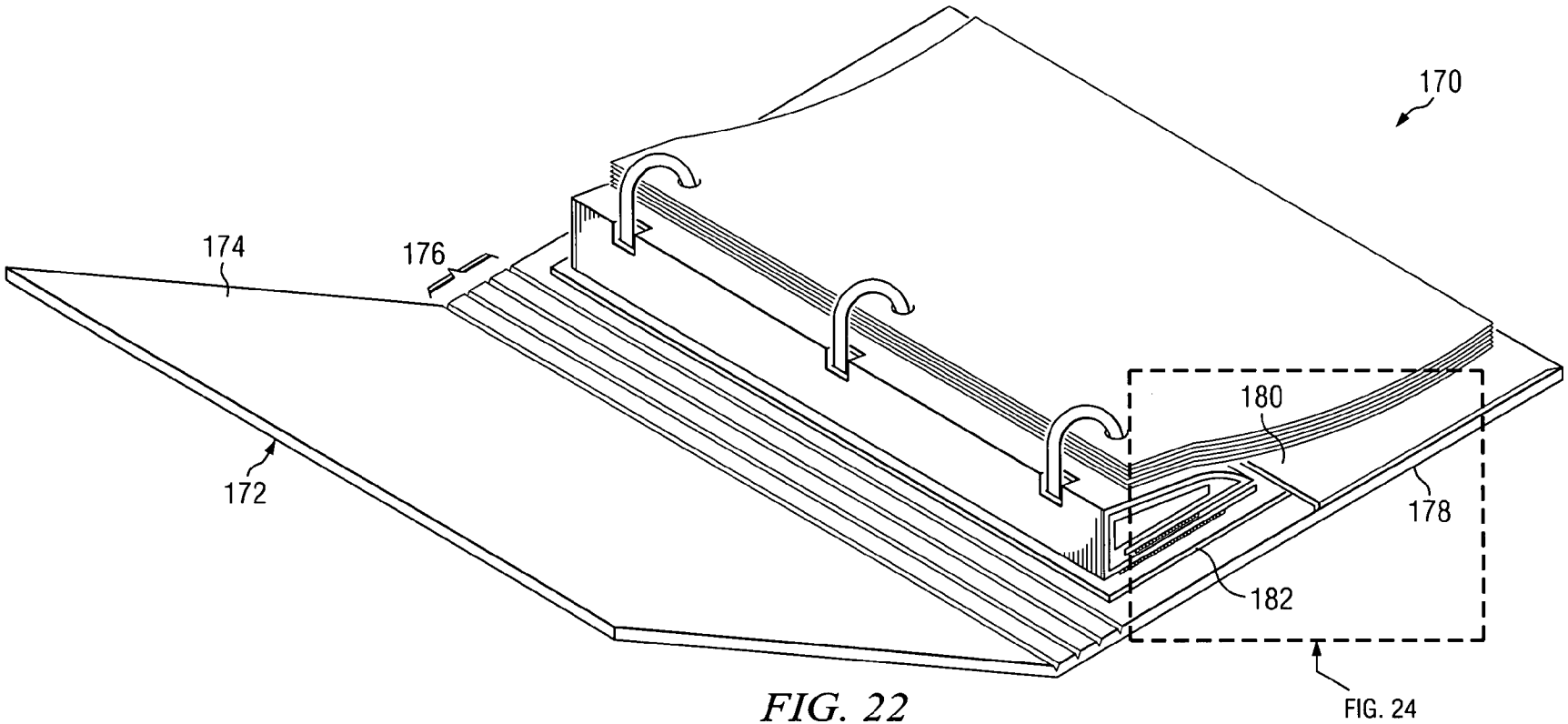
FIG. 22 is a cover that includes an insert slid into a pocket in the cover.
Figure 23:
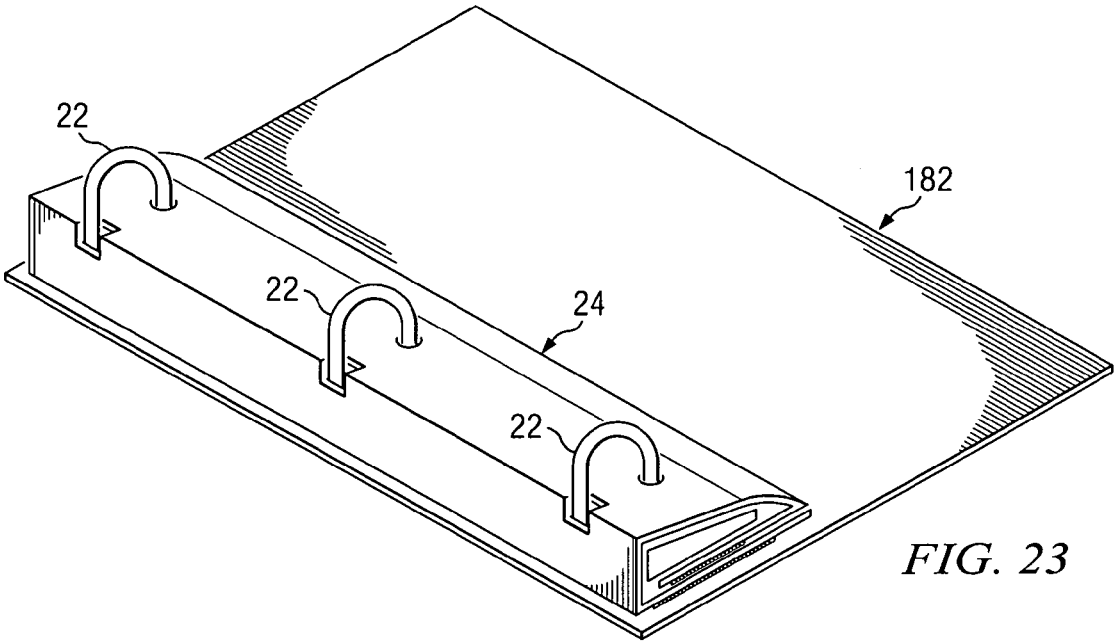
FIG. 23 is an insert for the cover of FIG. 22.
Figure 24:
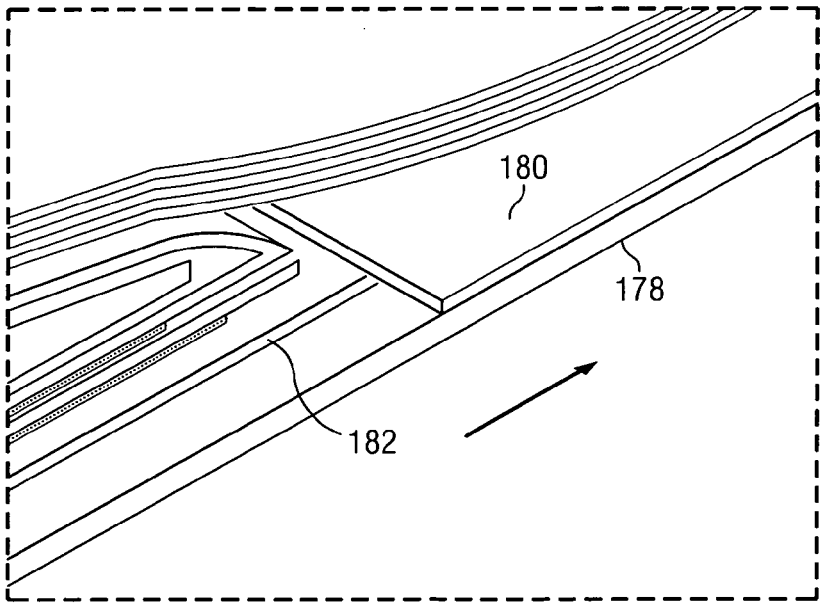
FIG. 24 is a detail view of the insert fitting into the pocket.

FIGS. 22, 23 and 24 illustrate a cover 170 that includes a member 172 with a front cover 174, spine 176 and back cover 178. The back cover 178 has a pocket 180 formed thereon. Cover 170 has an insert 182 that mounts ring binder 22 and paper surround 24 thereon as seen in the Figures and then is slid into the pocket 180 to complete the assembly of the cover. An advantage of cover 170 is that it allows the papers to be bound by ring elements 28 before the insert 182 is fit in the pocket 180 to make it easier to bind the papers. U.S. Pat. No. 6,682,248 issued Jan. 27, 2004 to Lockhart is incorporated in its entirety herein by reference. The insert 182 described herein can substitute for the insert 20 in this patent, allowing the ring binder 22 and paper surround 24 of the present invention to be used with the cover 26 disclosed in the patent.

Figure 25:
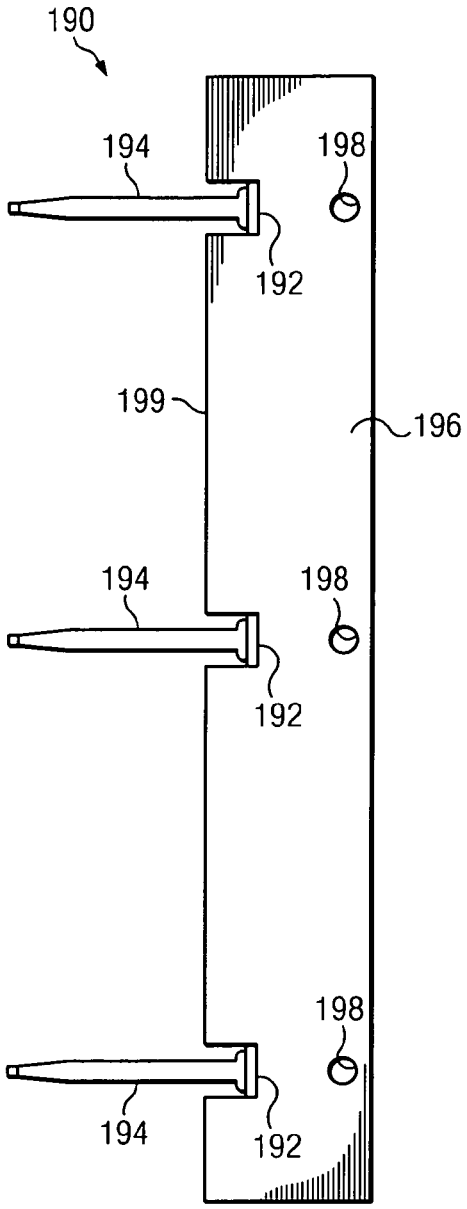
FIG. 25 is a modified ring binder with the hinges near the mid line of the base.
Figure 26:
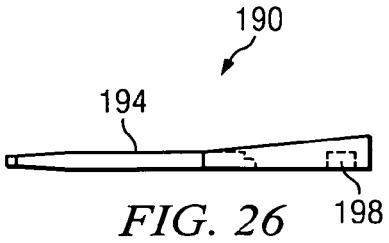
FIG. 26 is a side view of the modified ring binder of FIG. 25.
Figure 33:
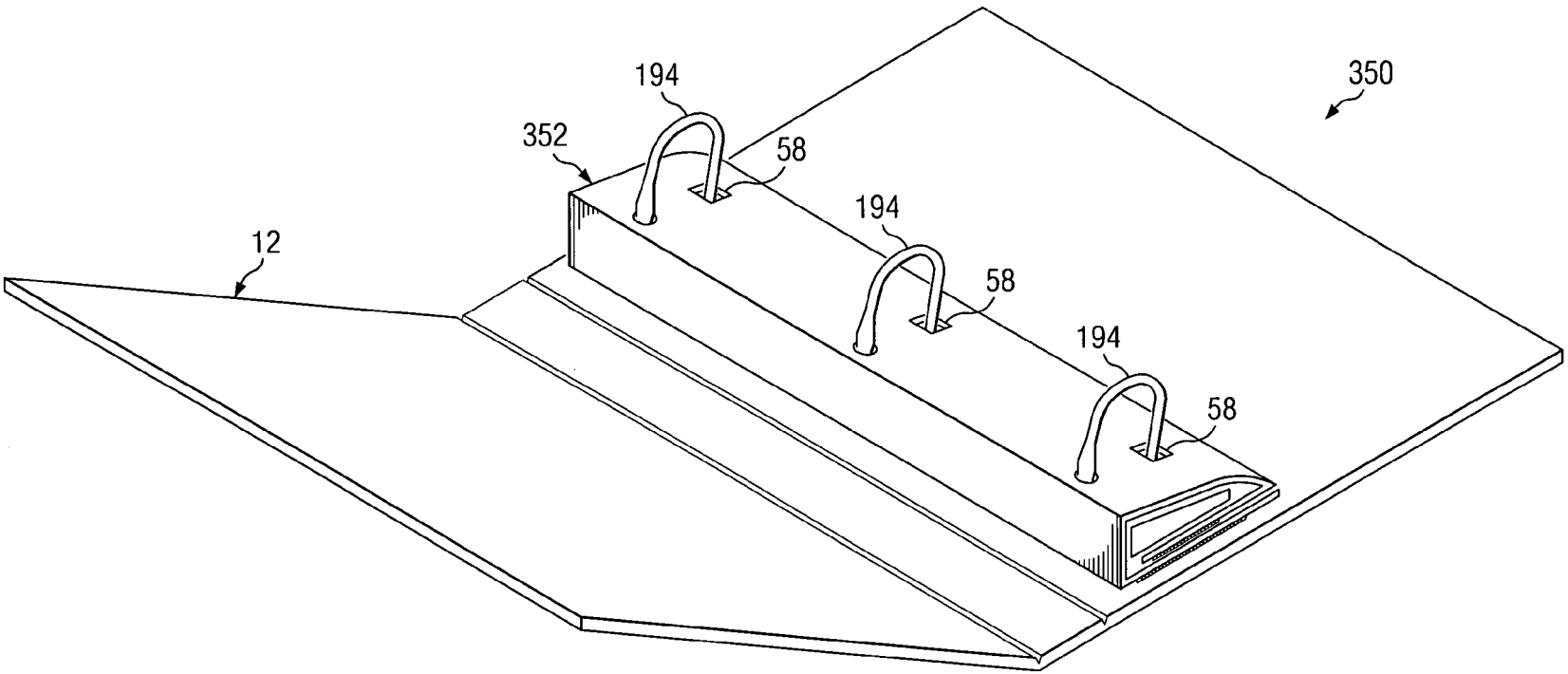
FIG. 33 is a perspective view of the cover of FIG. 32.

FIGS. 25, 26, 32 and 33 illustrate a cover 350 using a modified ring binder 190, as best seen in FIGS. 25 and 26. In ring binder 190, the hinges 192 for the ring elements 194 are deeply inset from the thin edge 199 of the base 196 of the ring binder 190, close to the mid-line of the base 196. The apertures 198 to receive the free ends of the ring elements 194 are close to the opposite edge of the base 196. The ring binder 190 is attached to member 12 such that the ring elements 194 are bent back toward the spine of the cover 350 and snap fit into the apertures 198 adjacent the spine. This design has the advantage that papers can be fit over the upstanding ring elements 194 facing upward in their normal reading position, which is a very natural motion for a person placing papers in the cover 350. Once the papers are placed over the ring elements, the free ends of the ring elements 194 are bent over toward the spine to be secured in the apertures 198. The paper surround 352 is identical to paper surround 24 except the apertures 58 and 60 are reversed in orientation and moved in position as seen in FIG. 33. The use of the inset is important as it pulls the papers held by the cover 350 closer to the spine, or if the cover 350 is a top bound cover using ring binder 190, closer to the top of the cover. In other words, with the ring elements hinged at hinges 192 spaced toward the spine or top from the thin edge 199, the edges of the papers are between the hinges 192 and spine or top. This allows the cover 350 to be reduced in width when a side bound design, and reduced in height when a top bound design. It is particulary important in the top bound design as the top bound design should not have a height over 12 inches to insure it will fit in standard file cabinets and the like.

Figure 27:
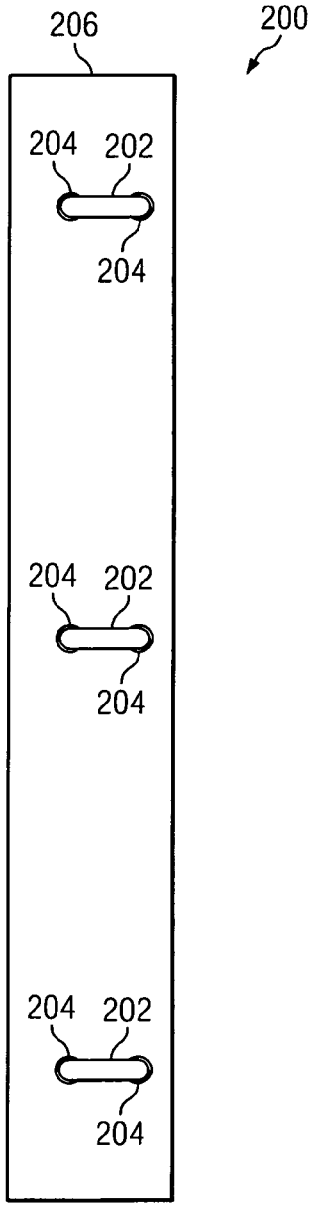
FIG. 27 is a top view of a modified ring binder with separate ring elements.
Figure 28:
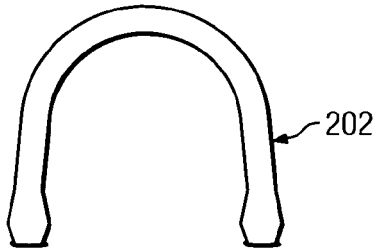
FIG. 28 is a side view of a separate ring element used with the ring binder of FIG. 27.

FIGS. 27 and 28 illustrate another modified ring binder 200 that has separate ring elements 202. Both ends of the ring elements 202 are free, and can be snap fit in apertures 204 in the base 206 of the ring binder 200 to complete the loops. This allows the base 206 and ring elements 202 to be formed separately, and of different materials, if desired. For example, base 206 can be formed of plastic while ring elements 202 are metal. The ring elements 202 can be manufactured in the final loop shape, or they can be linear, and only bent into the final loop shape as they are snap fit to the base 206.

Figure 29:
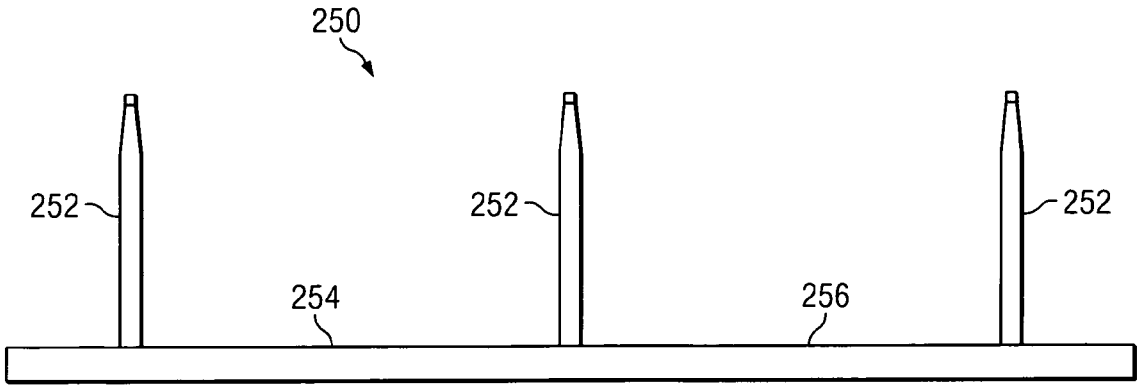
FIG. 29 is a side view of a modified ring binder with center extending ring elements.
Figure 30:
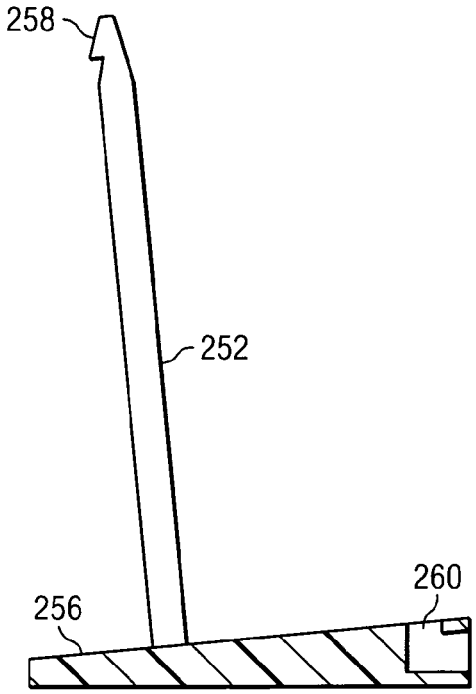
FIG. 30 is a side view of the ring binder of FIG. 29 before the ring elements form loops.
Figure 31:
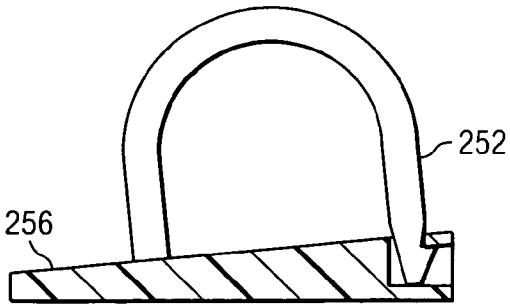
FIG. 31 is a side view of the ring binder of FIG. 29 with the ring elements forming loops.
Figure 32:
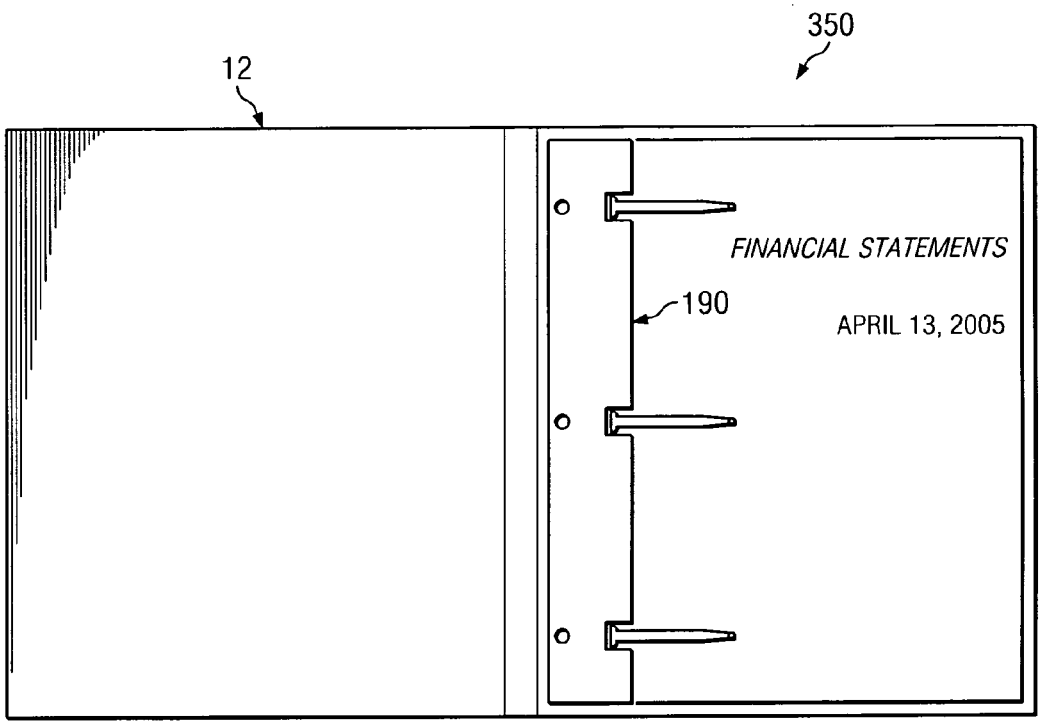
FIG. 32 is a plan view of a cover using the modified ring binder of FIG. 25.

FIGS. 29, 30 and 31 illustrate yet another modified ring binder 250. In binder 250, the ring elements 252 can be formed to extend roughly perpendicular the upper surface 254 of the base 256 before being formed into loops, as shown in FIGS. 29 and 30. The ring elements 252 are then bent over as shown in FIG. 31 to form loops, with the free end 258 of each ring element 252 having a hook to be snap fit in aperture 260 of the base 256. Binder 250 can, for example, be used in the cover 350.

While several embodiments of the present invention have been illustrated in the accompanying drawings and described in the foregoing detailed description, it will be understood that the invention is not limited to the embodiments disclosed, but is capable of numerous rearrangements, modifications and substitutions of parts and elements without departing the scope and spirit of the invention.

The invention claimed is:

1. A method for assembling a cover, comprising the steps of:

inserting ring elements of a ring binder through apertures in a flexible surround, the flexible surround having a outer back panel, spine panel and front panel, a first score line between the outer back panel and spine panel and a second score line between the spine panel and front panel;

wrapping the flexible surround about a base of the ring binder to encapsulate the base of the ring binder by folding the surround at the score lines;

fastening the flexible surround with the base of the ring binder encapsulated therein to a member forming at least a rear cover, the ring elements extending through the surround and exterior the surround; and inserting a free end of a ring element into an aperture in the base to receive the free end.

2. The method of claim 1 wherein the surround forms a portion of the member.

3. The method of claim 1 wherein the cover is either a top bound or a side bound cover and the surround is paper.

4. The method of claim 1 further comprising the steps of receiving the ring elements in linear form and subsequently bending the ring elements to form a loop to hold documents.

5. The method of claim 1 wherein the ring elements are thicker in the middle than at the ends to enhance service life.

6. The method of claim 1 further comprising the step of making the member and surround the same color.

7. The method of claim 6 further comprising making the ring binder the same color as the member and surround.

8. The method of claim 1 further comprising the steps of forming apertures in at least the front panel of the surround for passage of the ring elements.

9. The method of claim 1 wherein the surround further has an inner back panel and at least one score line between the inner back panel and the front panel, the method further including the steps of securing the surround about the ring binder with adhesive on the inner back panel and securing the surround and ring binder to the member with adhesive on the outer back panel.

10. The method of claim 1 further comprising the step of making the member include a front cover and spine.

11. The method of claim 1 further comprising the step of making the ring elements of uniform thickness.

12. The method of claim 1 further comprising the step of making the ring binder of polypropylene or nylon.

13. The method of claim 1 further comprising the step of adhering the ring binder directly to the member.

14. The method of claim 1 further comprising the step of securing the ring elements at at least one end thereof near an edge of the base.

15. The method of claim 1 further comprising the step of precurving the ring elements.

16. The method of claim 1 further comprising the step of tapering the base from a thick edge to a thin edge, the ring elements extending from the thick edge of the base and connected thereto through a living hinge.

17. A method for assembling a cover, comprising the steps of:

inserting ring elements of a ring binder through apertures in a flexible surround, the flexible surround having a outer back panel, spine panel and front panel, a first score line between the outer back panel and spine panel and a second score line between the spine panel and front panel;

wrapping the flexible surround about a base of the ring binder to encapsulate the base of the ring binder by folding the surround at the score lines;

fastening the flexible surround with the base of the ring binder encapsulated therein to a member forming at least a rear cover, the ring elements extending through the surround and exterior the surround; and tapering the base from a thick edge to a thin edge, the ring elements extending from an inset from the thin edge of the base and connected thereto through a living hinge.

18. The method of claim 17 wherein the base has a mid-line, the method further comprising the step of forming the inset from the thin edge close to the mid-line of the base.

* * * * *